US007105763B2

(12) United States Patent
Adams et al.

(10) Patent No.: US 7,105,763 B2
(45) Date of Patent: Sep. 12, 2006

(54) SWITCH ASSEMBLY

(75) Inventors: Jason O. Adams, Emmaus, PA (US); Gregory S. Altonen, Easton, PA (US); Glenn R. Bowers, Germansville, PA (US); Scott Alan Kleppinger, Macungie, PA (US); Nicole R. Vigue, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 26 days.

(21) Appl. No.: 10/686,387

(22) Filed: Oct. 14, 2003

(65) Prior Publication Data

US 2005/0077163 A1 Apr. 14, 2005

(51) Int. Cl.
*H01H 13/42* (2006.01)
*H01H 5/00* (2006.01)

(52) U.S. Cl. ..... 200/525; 200/437; 200/453; 200/457

(58) Field of Classification Search ..... 200/402–472, 200/520–535
See application file for complete search history.

(56) References Cited

U.S. PATENT DOCUMENTS

| | | | | | |
|---|---|---|---|---|---|
| 2,044,065 | A | * | 6/1936 | Douglas | 200/437 X |
| 2,095,180 | A | * | 10/1937 | Douglas | 200/437 |
| 2,469,337 | A | * | 5/1949 | Kohl | 200/437 |
| 3,046,377 | A | * | 7/1962 | Fraser | 200/455 |
| 3,183,333 | A | * | 5/1965 | Golbeck | 200/525 |
| 3,624,328 | A | * | 11/1971 | Hansen | 200/524 |
| 3,785,215 | A | * | 1/1974 | Stefani | 74/142 |
| 3,882,295 | A | | 5/1975 | Madland | 200/521 |
| 4,300,026 | A | * | 11/1981 | Bull | 200/525 |
| 4,319,106 | A | * | 3/1982 | Armitage | 200/526 |
| 4,757,164 | A | * | 7/1988 | Bauer et al. | 200/453 |
| 4,803,362 | A | | 2/1989 | Butts | 250/229 |
| 5,860,514 | A | | 1/1999 | Beattie | 200/523 |

FOREIGN PATENT DOCUMENTS

FR 2298176 8/1976

OTHER PUBLICATIONS

PCT Search Report.

* cited by examiner

*Primary Examiner*—K. Lee
(74) *Attorney, Agent, or Firm*—Drinker Biddle & Reath LLP

(57) ABSTRACT

A switch assembly includes an actuator assembly having a slidably supported pushbutton and a switch mechanism switchable between alternate positions. The pushbutton is biased by a return spring between the pushbutton and a retainer. A pin is received within the return spring coils and engages a pivot member through an elongated opening in the retainer that allows lateral pin movement. A switch plate moves between alternate positions by contact with the pivot member and is maintained in one of the positions by a contact spring between the pivot member and plate. A spring damper in the contact spring coils limits resonating vibration. The switch assembly provides a multiple segment force input profile having first and second segments leading to the switching force with slopes according to a preferred ratio. Third and fourth segments of the input profile following the switching force define a V-shape.

40 Claims, 9 Drawing Sheets

SWITCH ASSEMBLY

FIELD OF THE INVENTION

The present invention relates to switches, and more particularly to a wallbox-mountable switch assembly having a pushbutton.

BACKGROUND OF THE INVENTION

Wall-mountable switch assemblies providing on/off control of an electrical load, such as a lamp, are well known. Known switch assemblies include switch mechanisms actuated by a toggle supported for pivoting movement by a user. Known switch assemblies also include switch mechanisms actuated by pushbuttons supported for reciprocal sliding movement. Inward translation of the pushbutton in response to force applied by a user's finger actuates the switch mechanism. The pushbutton is outwardly biased to provide for return of the switch following release of the applied force.

The switch mechanisms used in known pushbutton switches are varied in their construction. Known pushbutton switches include pen-type switch mechanisms as disclosed in U.S. Pat. No. 4,319,106 to Armitage. It is also known to provide a pushbutton actuated switch with a ratcheting switch mechanism as disclosed in U.S. Pat. No. 3,785,215 to Stefani. It is also known to provide a pushbutton switch in which electrical circuit switching occurs only upon the release stroke of the pushbutton as disclosed in U.S. Pat. No. 3,624,328 to Hansen.

The force required to actuate the switch mechanism of a pushbutton switch will vary through the pushbutton range of movement between the fully-released position and the fully-engaged, hard stop, position. The actuation force will vary because of the resistance developed for outwardly biasing the pushbutton and the resistance presented by the switch mechanism against switching actuation.

The relationship between the pushbutton biasing resistance and the switch mechanism resistance affects user perception regarding quality of construction. Improper distribution between these two resistances can adversely affect tactile feedback presented to a user during the input stroke of the pushbutton. A pushbutton switch presenting an excessively large pushbutton biasing resistance, for example, can diminish tactile perception of transition associated with switching of the switch mechanism. The switching actuation of these switches tends to become masked by the biasing resistance and may feel "mushy" to a user. Conversely, a pushbutton switch having an excessively small pushbutton biasing resistance will create a sudden transition in resistance when the switch mechanism is engaged, which may present a jarring feedback in the nature of an impact with an obstacle.

SUMMARY OF THE INVENTION

According to the present invention there is provided a switch assembly for controlling an electrical load including a switch mechanism switchable between first and second alternate fixed electrical states. The switch assembly also includes an actuator assembly having a slidably supported pushbutton and engageable with the switch mechanism to switch the mechanism between the alternate fixed electrical states.

According to one aspect of the invention, the pushbutton of the actuator assembly is received by a pushbutton guide and is outwardly biased by a return member located between the pushbutton and a retainer. Preferably, the pushbutton guide is connected to an actuator mount received by a base housing in which the switch mechanism is mounted. The actuator assembly includes an elongated actuator member received through an opening in the retainer to engage the switch mechanism during inward translation of the pushbutton.

Preferably the return member is a spring having coils and the actuator member is a pin having a shaft portion received through the coils of the return spring. The actuator pin preferably includes a head portion defining a shoulder that contacts an end of the return spring for outwardly biasing the pin. Preferably, the return spring is conical and the opening in the retainer is elongated to permit lateral pivoting of the shaft portion of the pin.

According to one embodiment of the invention, the pushbutton includes a cap portion and a pushbutton carrier. The carrier includes a pedestal portion and a stand portion received within an interior defined by the cap portion. The pedestal portion is dimensioned for sliding receipt between opposite end walls of the pushbutton guide. Preferably, the carrier includes tab projections received within openings in the cap portion to releasably secure the cap portion to the carrier.

According to another aspect of the invention, the switch mechanism includes a switch plate having opposite upper and lower edges. The switch plate preferably includes at least one recess along the lower edge to define supports at opposite ends of the switch plate for supporting the switch plate on a support surface. Preferably, the switch plate holder is supported within a well defined by a switch plate holder.

The switch mechanism also includes a pivot member supported for pivoting about an axis. The pivot member is adapted for contact with the switch plate adjacent the upper edge of the support plate such that pivoting of the pivot member causes switching movement of the switch plate. The switch mechanism also includes contact elements secured to opposite sides of the switch plate contacting first and second fixed contact surfaces of the switch plate is switched between alternating first and second positions. Preferably, the fixed contact surfaces are defined by an arm extension of the switch plate holder and a contact element carried by a prong extension mounted in the base housing.

The switch mechanism further includes a spring located between the pivot member and the switch plate to apply a contact force between the contact elements and the fixed contact surfaces to maintain the switch plate in one of the alternate positions. Preferably, the switch plate includes recesses along the upper edge in which an end of the spring is received. The recesses preferably extend to a terminal end aligned with centers of the contact elements for substantial alignment between the end of the spring and the contact elements.

According to one embodiment, the pivot member of the switch mechanism includes a body defining a cross section having a substantially V-shaped middle portion and opposite end extensions forming ledges adapted for contact with the actuator assembly during inward translation of the pushbutton.

According to another aspect of the invention, the switch assembly includes a spring damper received within the coils of the switch mechanism spring to limit resonating vibrations in the spring coils following change of relative angular orientation between the pivot member and the switch plate. Preferably, the damper is made from a foam material to limit interference by the damper with axial compression of the spring.

The force applied to the pushbutton will vary during inward traveling of the pushbutton from resistance generated by the return spring of the actuator assembly and from resistance generated by the switch mechanism against switching between the alternate fixed positions. According to one aspect of the invention the input profile will include two segments between a fully released position of the pushbutton and that point at which sufficient force is applied to overcome the resistance generated by the switch mechanism against switching. These profile segments are divided by that point at which resistance is added by the switch mechanism. Preferably, the input profile is substantially linear in each of these segments, with the first segment slope having a value in a range of between approximately 30 percent and 60 percent of the second segment slope.

According to another aspect of the invention, the multiple segment input profile will include two segments between that point at which sufficient force is applied to overcome the switch mechanism resistance to switching and the fully engaged position of the pushbutton. These two segments are divided by that point at which the resistance of the switch mechanism against switching has been removed and further resistance will be generated only by the return spring to the fully engaged position. Preferably, the input profile in these two segments will define a substantially V-shaped profile.

According to another aspect of the invention, the switching assembly provides for limited passage of time before audible and visual feedback occurs following application of sufficient force to overcome the switch mechanism resistance to switching. Preferably, the audible feedback associated with the switching of the switch mechanism will occur within less than approximately 10 milliseconds. Preferably, visual feedback from an electrical load providing visual feedback, such as light from a lamp, will occur within less than approximately 50 milliseconds.

DESCRIPTION OF THE INVENTION

Figure 1:
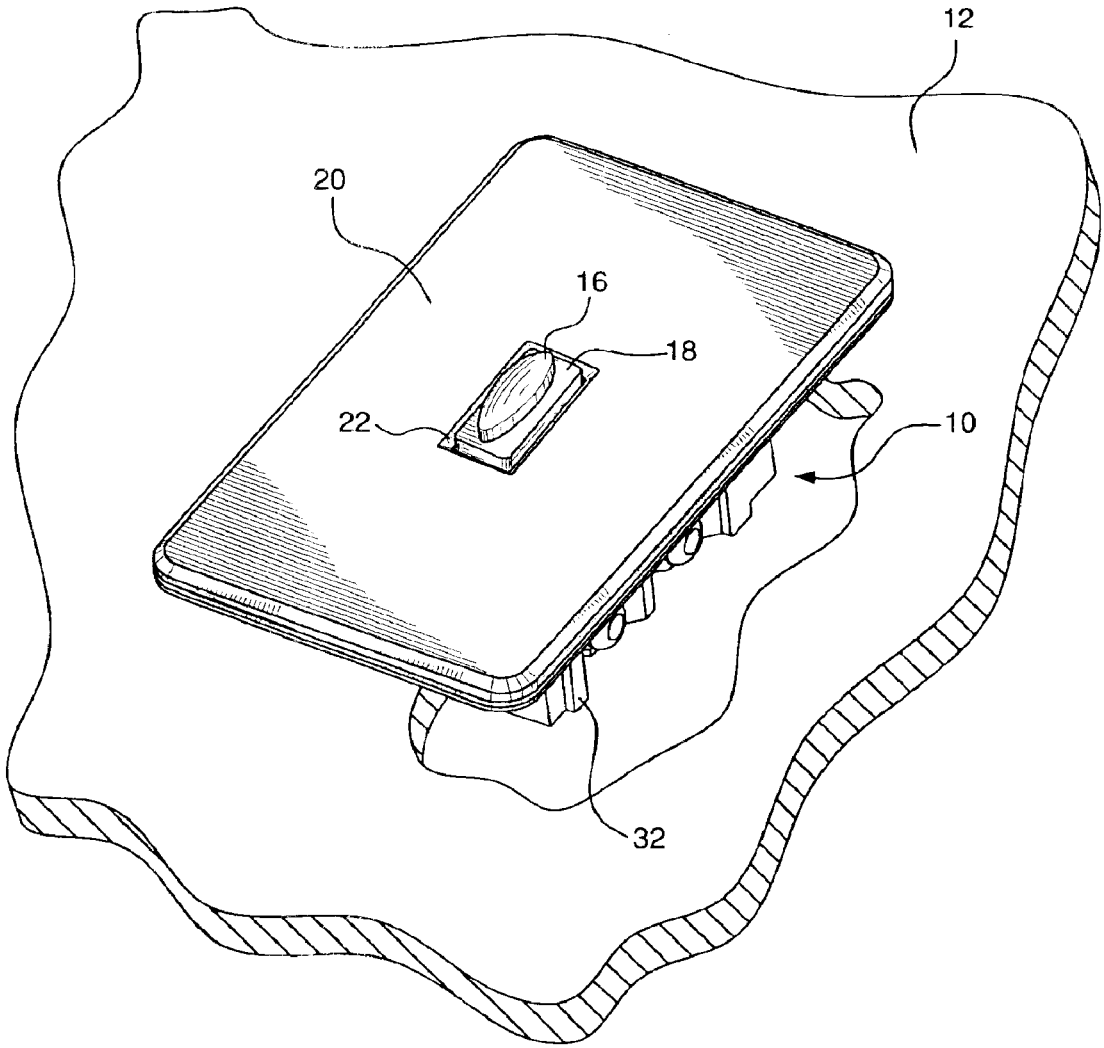
FIG. 1 is a perspective view of a switch assembly according to the present invention received by a wall-mounted faceplate having a standard toggle-type opening.

Referring to the drawings, where like numerals identify like elements, there is shown a switch assembly 10 according to the present invention for providing on/off control of an electrical load, such as a ceiling-mounted light or fan or a device powered via plug-in connection to a line source. Referring to FIG. 1, the switch assembly 10 is shown supported in a wall 12 to facilitate access by a user. The switch assembly 10 is adapted for engagement to a yoke 14 (see FIG. 2), the yoke being securable to a conventional electrical box installation in a manner that is well known.

The switch assembly 10 includes a pushbutton 16 supported for inward translation with respect to a pushbutton guide 18 in a sliding manner. As shown in FIG. 1, the pushbutton 16 and the pushbutton guide 18 are both elongated in shape and dimensioned to provide for their receipt by a faceplate 20 within a standard toggle-type opening 22 thereof. The particular shape and dimensions of the pushbutton 16, however, are not critical and may vary from that shown.

The pushbutton 16 and pushbutton guide 18 are part of an actuator assembly 24 that provides for switching actuation of a switch mechanism 26 of the switch assembly 10. The actuator assembly 24 actuates the switch mechanism 26 when force is applied to the pushbutton 16 by a user's finger for example. The actuator assembly 24 also provides a biasing force for outward return of the pushbutton 16 following release of the applied force.

The pushbutton guide 18 is connected to an actuator mount 28. The pushbutton guide 18 is preferably formed integrally with the actuator mount 28 from a molded plastic material for example. The actuator mount 28 includes tab projections 30 adjacent opposite ends of the pushbutton guide 18. The tab projections 30 are elongated such that they are capable of flexing with respect to the actuator mount 28 to facilitate a releasable snap connection between the actuator mount 28 and the yoke 14 as shown in FIG. 2.

A base housing 32 receives the actuator mount 28 to define an interior for the switch assembly 10. As shown in FIGS. 2 and 3, projecting portions 33 on opposite sides of the actuator mount 28 are received in elongated recesses 35 formed in the base housing 32. The actuator mount 28 also includes an elongated flap portion 37, which serves to close an opening 41 in a sidewall 39 of the base housing 32. The base housing 32 includes tab projections 43 for releasable connection to the yoke 14 to secure the actuator mount 28, base housing 32, and yoke 14 together.

Figure 2:
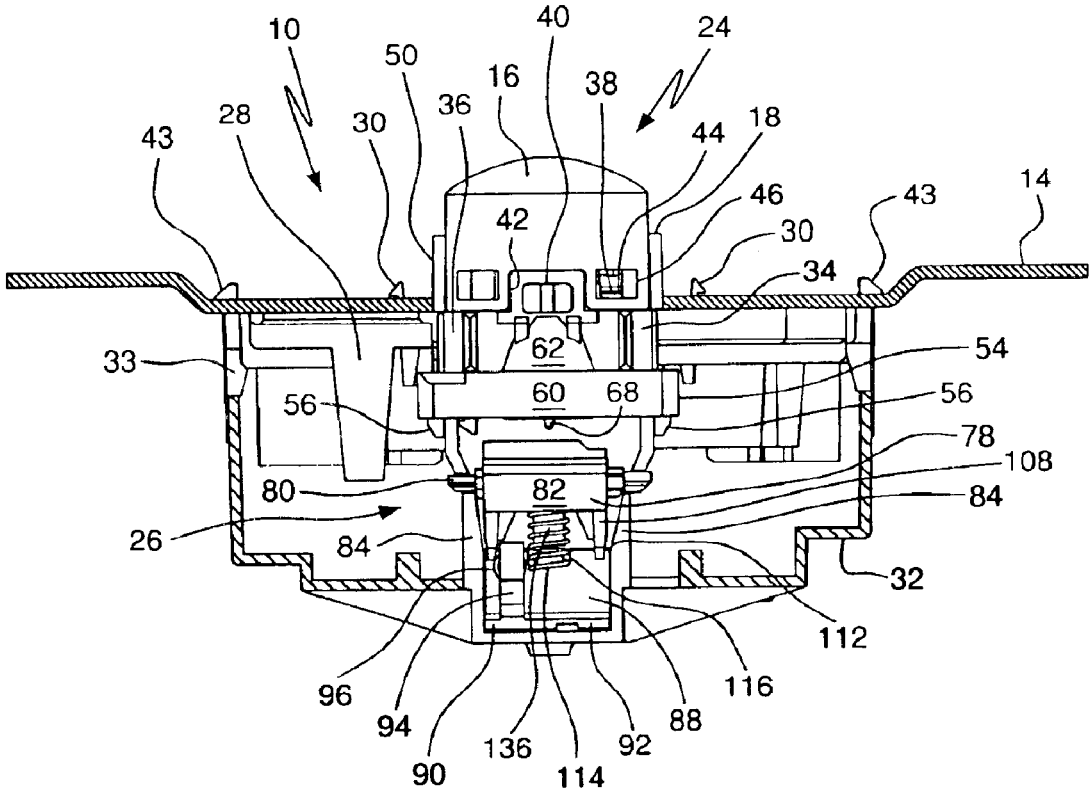
FIG. 2 is a side view, partly in section, of the switch assembly of FIG. 1.
Figure 3:
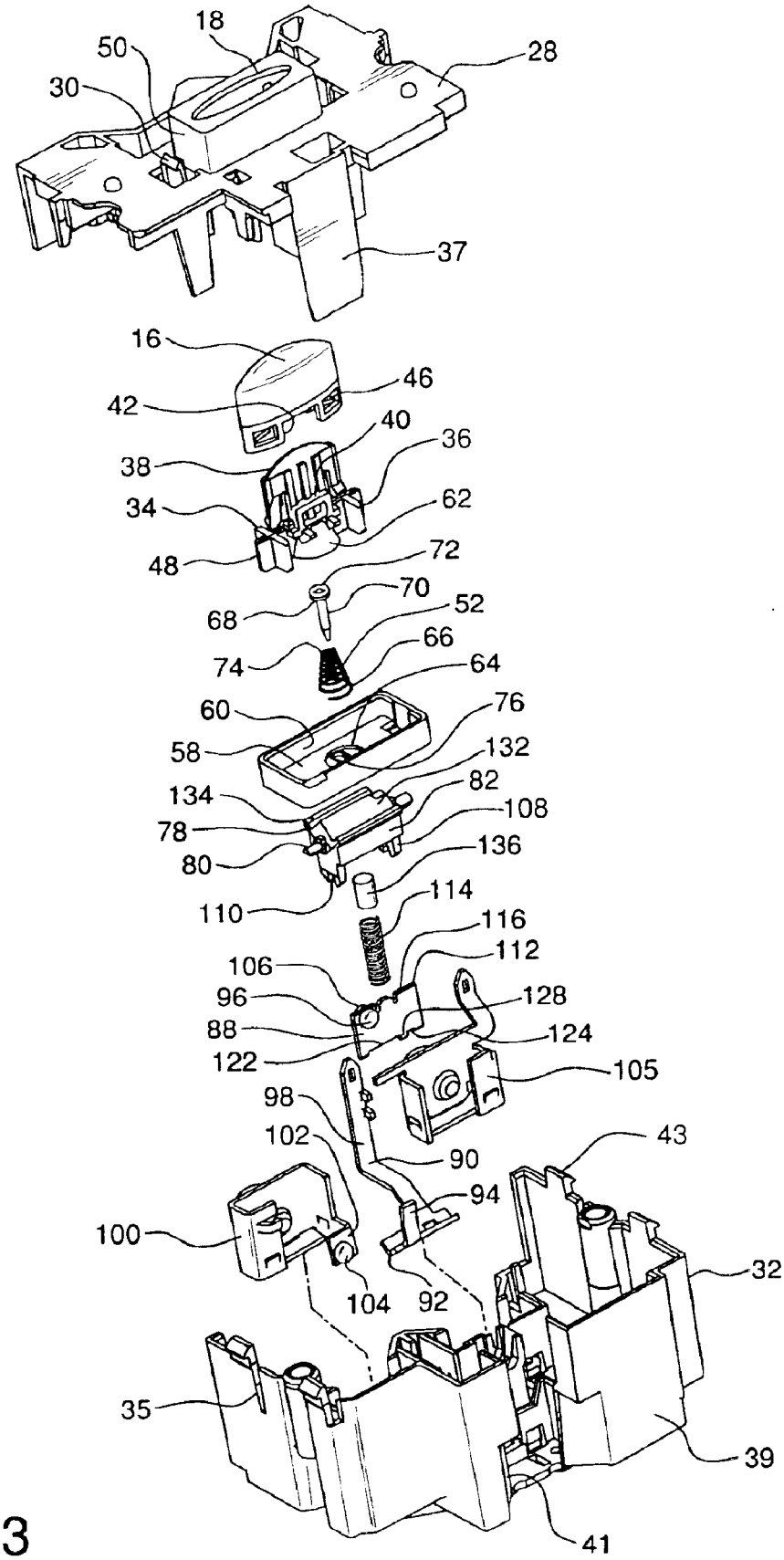
FIG. 3 is an exploded perspective view of the switch assembly of FIG. 1.

Referring to FIG. 2 and the exploded view of FIG. 3, the actuator assembly 24 includes a pushbutton carrier 34. The pushbutton carrier 34 includes a pedestal portion 36 and a stand portion 38 connected to the pedestal portion 36. As shown in FIG. 2, the stand portion 38 of the pushbutton carrier 34 is dimensioned for receipt within an interior defined by the pushbutton 16 such that the pushbutton 16 forms a removable cap with respect to the pushbutton carrier 34. The stand portion 38 includes base guides 40 on opposite sides thereof that are dimensioned for sliding receipt by recesses 42 formed on opposite sides of the pushbutton 16. The stand portion 38 of the pushbutton carrier 34 also includes a pair of elongated tab projections 44 adapted for snap receipt by openings 46 formed in the pushbutton 16 to releasably secure the pushbutton 16 to the pushbutton carrier 34. The pedestal portion 36 of the pushbutton carrier 34 includes opposite ends 48 that are dimensioned for sliding receipt between opposite end walls 50 of the pushbutton guide 18.

The actuator assembly 24 also includes a pushbutton return spring 52 located between the pushbutton carrier 34 and a retainer 54 to outwardly bias the pushbutton 16. The retainer 54 is secured to the actuator mount 28 to provide a reaction surface for compression of the pushbutton return spring 52 during inward translation of the pushbutton 16. The compression of pushbutton return spring 52 provides for outward return of the pushbutton 16 following removal of actuating force from the pushbutton. Elongated tabs 56 extending from the end walls 50 of pushbutton guide 18 are received by a plate portion 58 of retainer 54 for releasable connection between the retainer 54 and the pushbutton guide 18. The retainer 54 also includes an upstanding sidewall portion 60 such that the retainer 54 defines a tray-like construction. The pushbutton return spring 52 is conical in shape and is received within a bell-shaped receptacle 62 connected to the pedestal portion 36 of the pushbutton carrier 34, preferably integrally as part of a plastic molding process. A lower end 66 of pushbutton return spring 52 is received in a recessed portion 64 of the retainer plate portion 58.

The actuator assembly 24 also includes a pin 68, preferably made from a plastic material. The pin 68 includes a shaft portion 70 having a tapered end and a head portion 72 defining an annular shoulder adjacent the shaft portion. The shaft portion 70 of pin 68 is received through an upper end 74 of the return spring 52 such that the head portion 72 contacts the upper end 74 of pushbutton return spring 52. When force is applied to the pushbutton 16, by a user's finger for example, the pin 68 is driven through an opening 76 in the recessed portion 64 of retainer 54 compressing the pushbutton return spring 52. The opening 76 in the retainer 54 forms an elongated slot, which allows the shaft portion 70 of pin 68 to pivot laterally with respect to the retainer 54. As described in greater detail below, the provision of such freedom allows the pin shaft 70 to actuate the switch mechanism 26 of the switch assembly 10.

Figure 5:
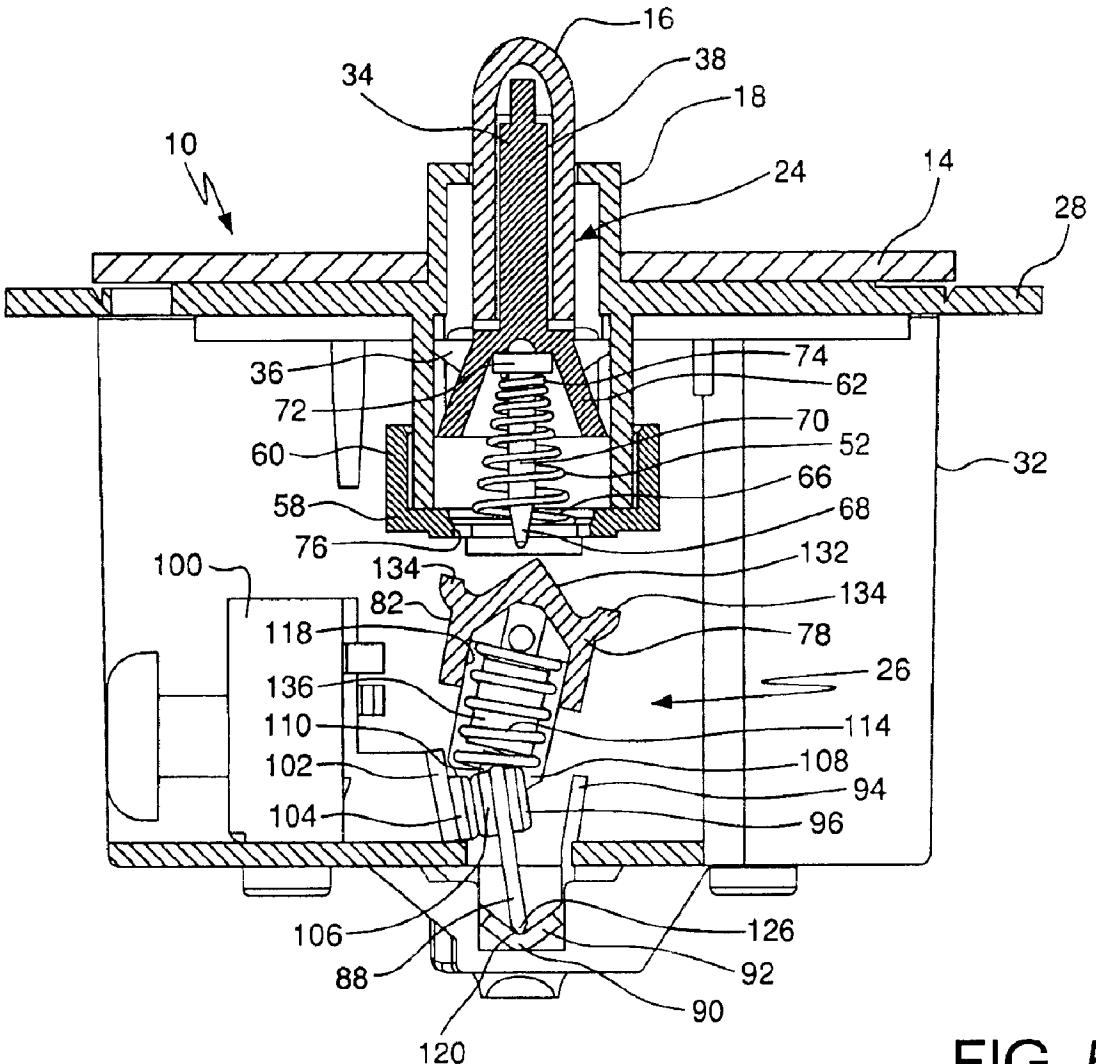
FIG. 5 is an end view, partly in section, of the switch assembly of FIG. 1 with the button actuator in a fully-released position and the switch plate in one of two alternate fixed positions.
Figure 6:
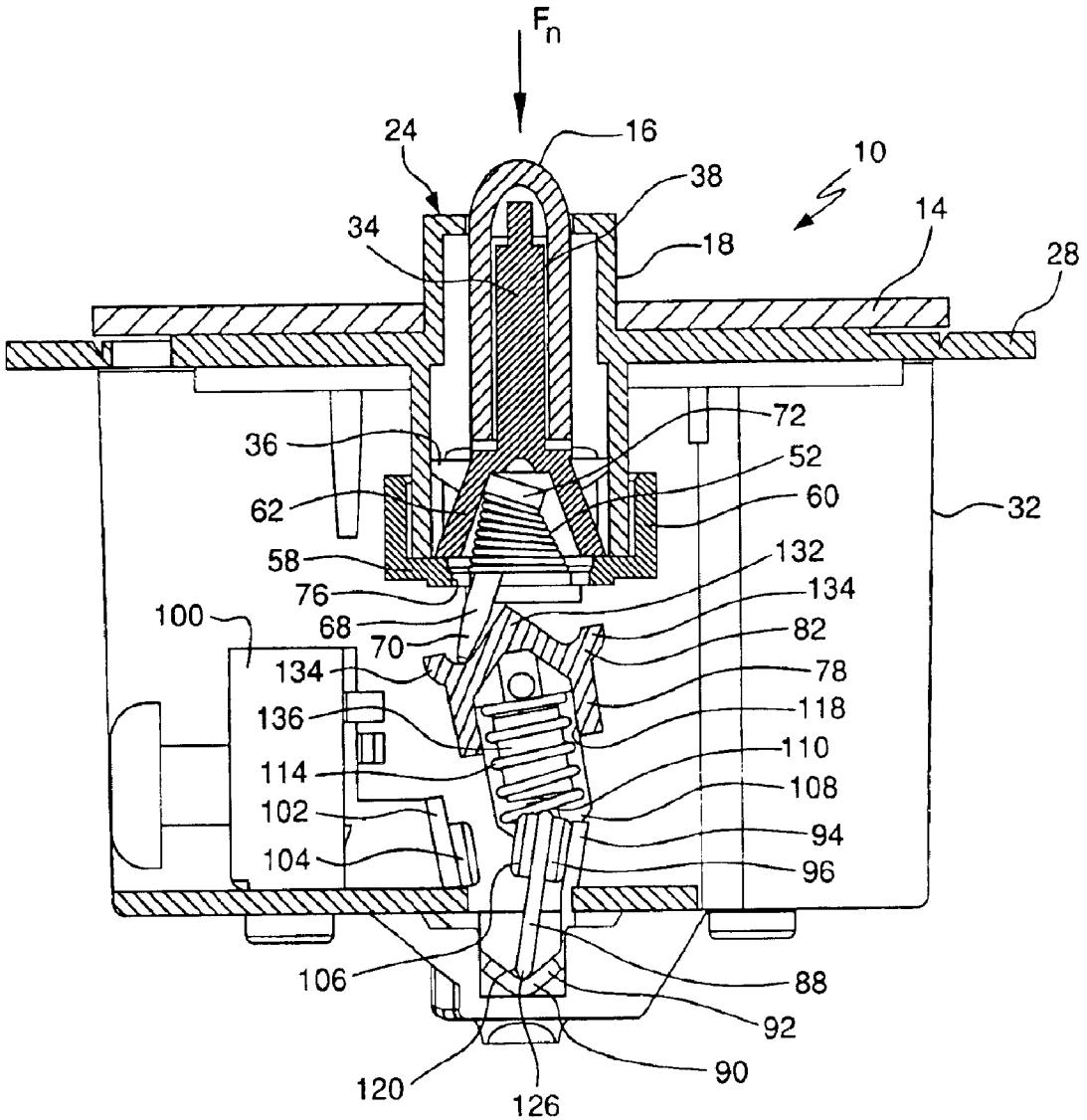
FIG. 6 is an end view, partly in section, of the switch assembly of FIG. 1 with the button actuator in a fully-engaged position and the switch plate switched to the other one of the alternate fixed positions.

The switch mechanism 26 of switch assembly 10 defines alternate first and second fixed electrical positions, respectively shown in FIGS. 6 and 5. Actuation of the switch mechanism 26 by the actuator assembly 24 results in switching of the switch mechanism between the alternate fixed electrical positions. The switch mechanism 26 includes a pivot member 78 having posts 80 extending from opposite ends of a central body 82. The posts 80 are received in openings in upstanding supports 84 carried by the base housing 32, preferably formed from molded plastic integrally with the base housing, for rotatable support of the pivot member 78 within the base housing 32.

The switch mechanism 26 includes a switch plate 88 supported by a switch plate holder 90 received by the base housing 32. The switch plate 88 is received by a well portion 92 defined at a lower end of the plate holder 90. The switch plate 88 and the plate holder 90 are preferably made from cartridge brass. The plate holder 90 includes an arm extension 94 connected to the well portion 92. The arm extension 94 is located adjacent one end of the well portion 92 for contact with a conductive contact element 96 secured to a first side of the switch plate 88 with the switch mechanism 26 in the first fixed position of FIG. 6. Preferably, the plate holder 90 is coated with a thin coating of silver to limit wearing damage of contact surfaces. The switch plate 90 also includes an elongated prong extension 98 connected to the well portion 92 opposite the arm extension 94.

The switch mechanism 26 also includes a traveler terminal 100 received by the base housing 32. A contact support prong 102 carrying an electrical contact element 104 extends from traveler terminal 100. The contact element 104 contacts a contact element 106 secured to a second side of the switch plate 88 when the switch plate is in the second fixed position shown in FIG. 5.

The switch mechanism 26 shown in the figures is a single-pole switch. The first switch position of FIG. 6 provides an open-circuit condition in which electrical current will not flow through the switch mechanism 26. A closed circuit condition is provided when the mechanism 26 is switched to the second switch position of FIG. 5. The current path through the mechanism 26 in the second switch position is as follows. Entering into the circuit through the traveler terminal 100, the path extends to the switch plate 88 through the electrical connection provided between the contact elements 104, 106. The path continues from the switch plate 88 to the switch plate holder 90 through contacting surfaces between the switch plate 88 and the well portion 92 of plate holder 90. The current path exits from the mechanism 26 through a common terminal 105, which is electrically connected to the prong extension 98 of the plate holder 90.

The switch assembly may include a circuit board (not shown) electrically connected to the above-described path, through the prong 98 of plate holder 90 for example, to receive electrical current when the switch mechanism is in the closed-circuit condition of FIG. 5. The present invention is not limited to the single-pole switch shown in the figures. The switch mechanism could be modified, for example, to include a second traveler terminal opposite traveler terminal 100 and supporting an electrical contact element. Such a modified switch mechanism provides for a three-way switch having two closed-contact positions.

Figure 7:
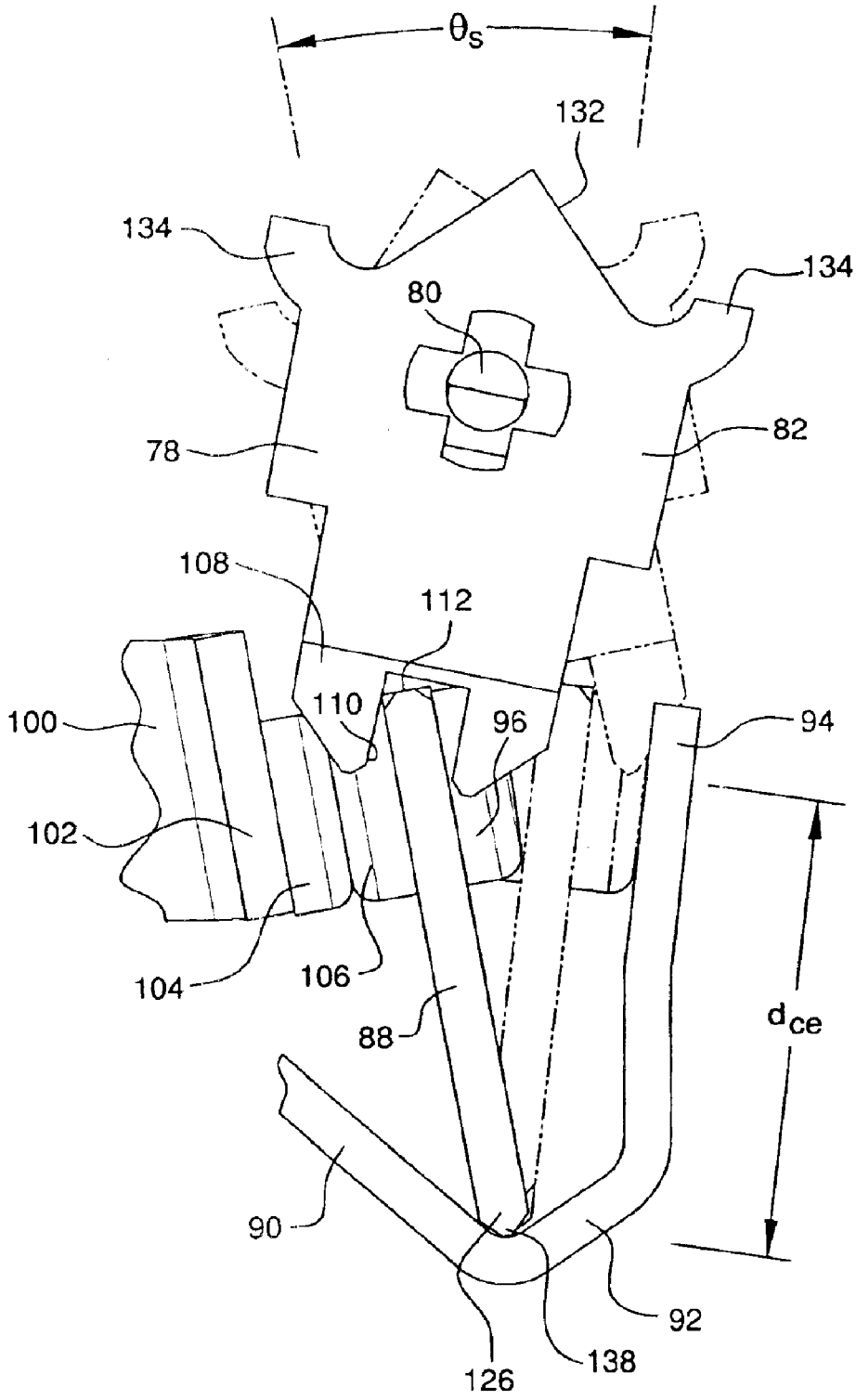
FIG. 7 is a partial end view of the switch assembly of FIG. 1 showing the switch plate in the alternate fixed positions.

Referring to FIGS. 3 and 7, the pivot member 78 includes downwardly extending legs 108 at opposite ends of the body 82. Each leg 108 defines a recess 110 adapted to receive an upper edge 112 of the switch plate 88 adjacent opposite ends of the switch plate. This arrangement results in contact between the switch plate 88 and the legs 108 of the pivot member 78 as the pivot member is pivoted and corresponding movement of the switch plate 88 between the alternate fixed positions of FIGS. 5 and 6.

Figure 4:
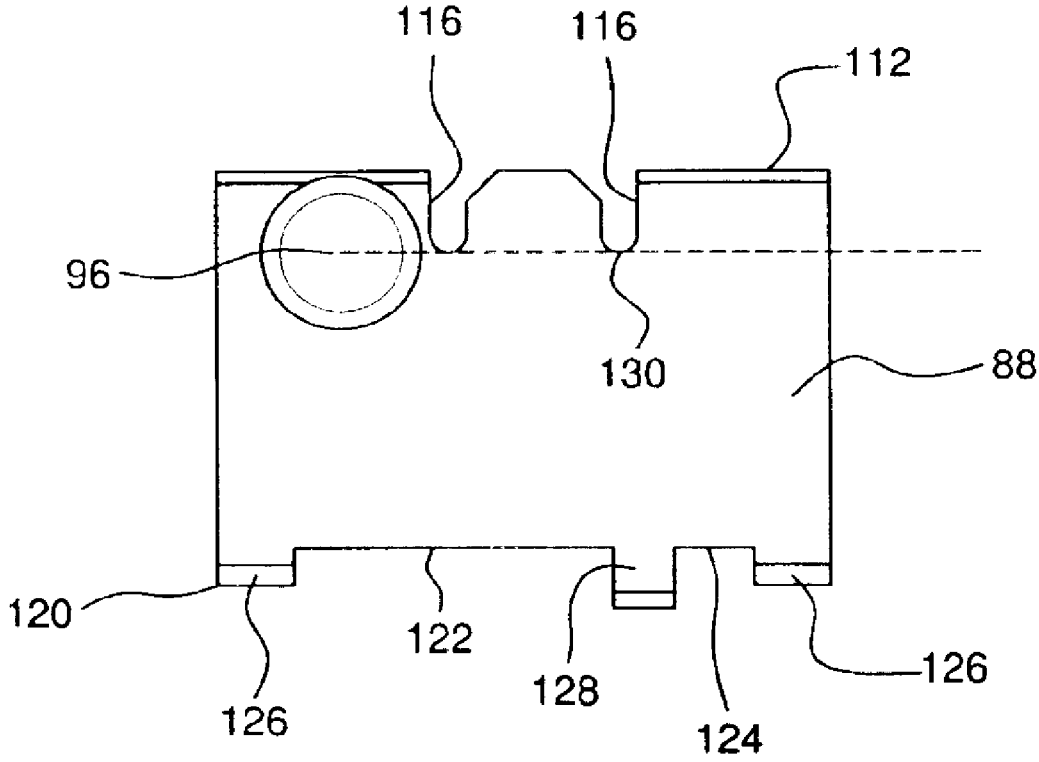
FIG. 4 is a front view of the switch plate of the switch assembly of FIG. 1.

The switch mechanism 26 includes a spring 114 located between the pivot member 78 and the switch plate 88. Located in this manner, the spring 114 reacts against the pivot member 78 and applies force to the switch plate 88 for maintaining the switch plate 88 in one of the alternate fixed positions of FIGS. 5 and 6. The force applied by the spring 114 may be referred to hereinafter as the "contact force". Referring to FIG. 4, the spring 114 engages an upper edge 112 of the switch plate 88 at one end of the spring in close proximity to the contact elements 96, 106. The end of spring 114 is received in spaced recessed formed in the upper edge 112 of switch plate 88. As shown in FIGS. 5 and 6, an opposite end of spring 114 is received in a recessed portion 118 of the pivot member 78 defined by the body 82.

As shown in FIG. 4, the lower edge 120 of the switch plate 88 includes recesses 122, 124. The recesses define opposite support legs 126 adjacent the ends of the switch plate 88 for contact with the well portion 92 of plate holder 90. The switch plate 88 also includes a projecting portion 128 defined between the recesses 122,124. The projecting portion 128 is received through an opening in the well portion 92 of switch plate holder 90. The projecting portion 128 forms an assembly key ensuring correct orientation between the switch plate 88 and the plate holder 90.

The recesses 122, 124 defining support legs 126 limit the surface contact area that would otherwise exist between the lower edge 120 of switch plate 88 and the well portion 92 of plate holder 90. As shown in FIGS. 5 and 6, the switch plate support legs 126 are also tapered to form knife-edged bearing surfaces at the terminal ends of the legs. The reduced surface contact area provided at the knife-edged support legs 126 increases pressure between the contact surfaces in response to the contact force of spring 114 over that which would be created were the plate 88 supported along the entire lower edge 120.

Referring again to FIG. 4, the spaced recesses 116 in which the end of spring 114 is engaged extend into the plate 88 to terminal ends 130. As shown, the recess ends 130 are substantially aligned with the centers of the electrical contact elements 96, 106 secured to the opposite sides of the switch plate 88. This alignment between the recess ends 130 and the contact element centers provides for substantial alignment between the engaged end of the spring 114 and the contact elements 96, 106, as shown in FIG. 2. Such alignment reduces torque otherwise applied to the switch plate 88 by misalignment between the end of the spring 114, which defines the point of force application to the switch plate 88, and the contact elements 96, 106, which define the force reaction point where the contact force is applied.

Referring to FIGS. 5–7, the operation of the switch assembly 10 is as follows. The switch assembly 10 is shown in FIG. 5 with the actuator assembly 24 in a fully-released condition with the pushbutton 16 outwardly biased with respect to the pushbutton guide 18. In the released condition of FIG. 5, the switch mechanism 26 of switch assembly 10 is in the second, closed-circuit, position with elements 104, 106 in contact with each other. The pivot member 78 in its second position is pivoted beyond a vertical orientation in a clockwise direction, from the point of view shown in FIG. 5. As shown, the conical pushbutton return spring 52 reacting against the retainer 54 biases the pin 68 upwardly from the retainer in the view shown. The action of pushbutton return spring 52 on pin 68 also has the effect of orienting the pin in a substantially vertical orientation in which the pin shaft 70 is not laterally pivoted with respect to the retainer 54. The action of pushbutton return spring 52 also causes the head portion 72 of pin 68 to hold the pushbutton carrier 34 and pushbutton 16 in the outwardly biased position shown in FIG. 5.

Application of force to the pushbutton 16, as shown in FIG. 6, results in inward translation of the pushbutton carrier 34 within the pushbutton guide 18 and corresponding extension of the shaft portion 70 of pin 68 through the opening 76 in retainer 54. As shown in FIGS. 5 and 6, the conical pushbutton return spring 52 is compressed within the bell-shaped receptacle 62. As shown, the cross section of the body 82 of pivot member 78 includes a middle part 132, shaped substantially in the form of an inverted V, and projecting parts at opposite ends of the middle part 132 defining ledge extensions 134. Contact between the pin 68 and the pivot member 78 causes the pin shaft 70 to translate along the left-hand side of the V-shaped middle part 132 from the point of view shown in FIGS. 5 and 6. As shown, the pin shaft 70 also pivots laterally in the elongated opening 76 provided in retainer 54 as it translates along the V-shaped middle part 132. Contact between the pin shaft 70 and the left-hand ledge extension 134 forces the pivot member 78 to pivot in a counterclockwise direction from the point of view shown in FIGS. 5 and 6.

The downwardly extending legs 108 of pivot member 78 contact the switch plate 88 adjacent its upper edge 112 as the pivot member 78 is pivoted. This contact results in switching movement of the switch plate 88 from its second closed contact position shown in FIG. 5 to its first closed contact position shown in FIG. 6. The compression of the contact spring 114 will be at a minimum when the switch mechanism 16 is in the alternate fixed positions and will increase during the switching actuation as the switch mechanism is moved between the two positions.

The orientation of the pivot member 78, switched to the first switch position of FIG. 6, positions the pivot member 78 for contact between the pin 68 and the right-hand side of the V-shaped middle part 132 of pivot member 78 on the next actuation of the switch mechanism 26. Contact between the right-hand side ledge extension 134 and the pin 68 during that actuation will pivot the pivot member 78 in a clockwise direction from the point of view of FIGS. 5 and 6. The pivoting of the pivot member 78 will move the switch plate 88 from its second switch position to its first switch position, as shown in FIG. 7.

Electrical resistance at the contact elements 96, 106 is inversely proportional to the contact force applied at the contact elements 96, 106. Increasing the contact force applied to switch plate 88, however, increases the resistance to switching movement thereby undesirably increasing the actuator force that must be applied to pushbutton 16. The above-described optimized pressure provided by the knifed-edge switch plate support legs 126 facilitates switching actuation of the switch plate 88 thereby providing for switching actuation at a lower actuator force for a given contact force applied by spring 114.

Efficient switch actuation at reduced actuator force is further promoted by the above-described torque-limiting alignment between the spring 114 and the contact elements 96, 106. As a non-limiting example, a switch assembly adapted for use in a standard toggle-type opening as shown in the figures and having the capability of switching 15 amps, 120–277V, developed a contact force of approximately 0.10 pounds. The switch mechanism of the assembly, however was switchable between its alternate fixed positions in response to an actuation force of approximately 0.8 pounds or less applied to the pushbutton 16.

As discussed above, the spring 114 applies force to switch plate 88 to maintain the switch plate 88 in one of the alternate fixed positions of FIGS. 5 and 6. As a result of the force applied to switch plate 88 by spring 114, the actuated movement of the switch plate will involve a relatively rapid snap, or flip, movement of the switch plate between its alternate positions as the contact force is overcome. Rapid snapping movement of switch plate 88 in this manner tends to result in a contact bounce, or bounces, upon impact between the contact elements 96, 106 and the arm 94 of switch plate holder 90 and contact element 104, respectively. When switched to the closed-contact position of FIG. 5, the momentary separation between the contact elements 104, 106 will result in arcing between the surfaces of the contact elements. Such arcing tends to heat the contact surfaces leading to micro-welding between the contact surfaces under subsequent sustained contact. Separation following the micro-welding results in damage of the contact surfaces. The electrical contact elements 104, 106 are preferably made from silver cadmium oxide to reduce micro-welding caused by the arc heating. Such reduced welding of the contact surfaces desirably extends the life of the contact elements of the switch mechanism.

As described above, the over-center spring 114 will deflect lengthwise during switching actuation because of the change in relative angular orientation between the switch plate 88 and pivot member 78. The change in the lengthwise configuration of the over-center spring 114 will occur rapidly along with the corresponding snap movement of the switch plate 88, described above. This rapid change in the spring configuration causes resonating vibration of the coils of spring 114, which translates into a ringing noise. Ringing noises generated by the over-center spring 114 would create an undesirable perception of lack of quality in the construction of the switch assembly 10. The switch assembly 10 of the present invention includes a spring damper 136 received within the coils of the contact spring 114, as shown in FIGS. 5 and 6 for example. Contact between the spring damper 136 and the coils of the spring 114 functions to limit vibration of the coils, thereby reducing ringing noise following the napping movement of the switch plate 88. The spring damper 136 is preferably cylindrical in shape to provide optimum contact between the damper and the coils of spring 114. The spring damper 136 is preferably made from a resilient material, such as a foam material, to allow for sufficient axial compression of the spring 114.

The switching movement of the switch plate 88 was further controlled by optimizing the dimensions of the switch plate and the respective location of the arm 94 of switch plate holder 90 and the prong 102 of traveler terminal 100. Referring to FIG. 7, the distance between the upper and lower edges 112, 120 defining the width of the switch plate 88 was optimized to reduce the distance, shown as $d_{ce}$, between the contact elements 96, 106 and the lower edges 138 of the knifed-edge support legs 126. The point of contact between the leg edges 138 and the well 92 of plate holder 90 defines a center for pivoting movement of the switch plate 88 as it flips between alternate positions. The respective locations of the plate holder arm 94 and the traveler terminal prong 102 were also optimized to reduce the angle of pivoting for switch plate 88, shown as $\theta_s$, as it flips between its alternate positions. Preferably the angle of pivoting of the switch plate 88 between the first and second fixed positions is approximately 20 degrees.

Reduction in the contact distance, $d_{ce}$, and the plate pivoting angle, $\theta_s$, reduces the distance over which the contact elements 96, 106 will be moved between the alternate switch positions. Reduction in the movement distance results in reduction in the acceleration time for the contact elements 96, 106 and a corresponding reduction in maximum velocity for the contact elements. This desirably limits momentum generated during the switching movement, thereby desirably limiting the above-described contact bouncing and the associated damage.

It should be understood that the above-described optimization of the switch plate pivot angle, $\theta_s$, and contact distance, $d_{ce}$, represents a trade-off between the benefits provided for the switch plate 88 and efficiencies regarding the pivoting movement of the pivot member 78. The reduction of $\theta_s$ and $d_{ce}$ should not be so large as to significantly impair the operation of the pivot member 78.

Figure 8:
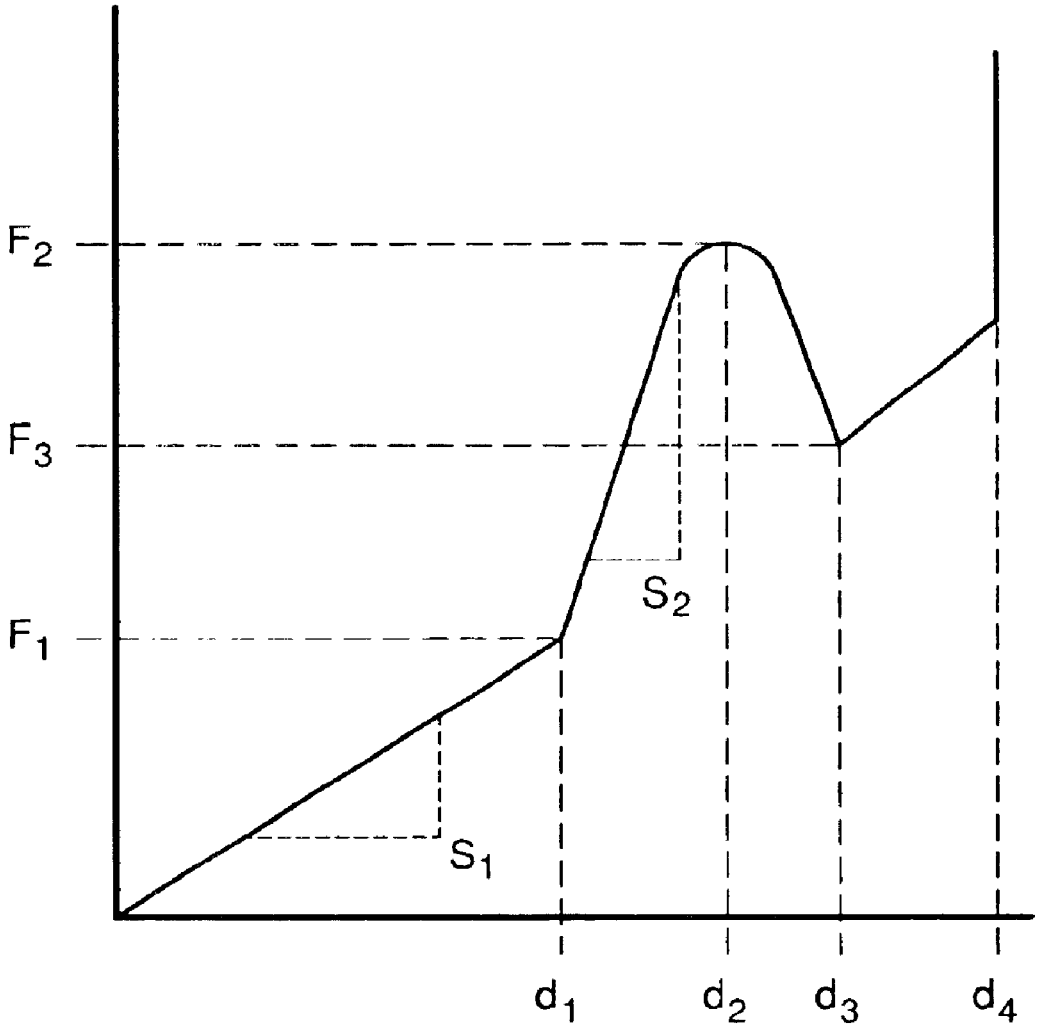
FIG. 8 is a graphical illustration of the force and actuator travel distance characteristics of the switch assembly of the present invention.
Figure 9:
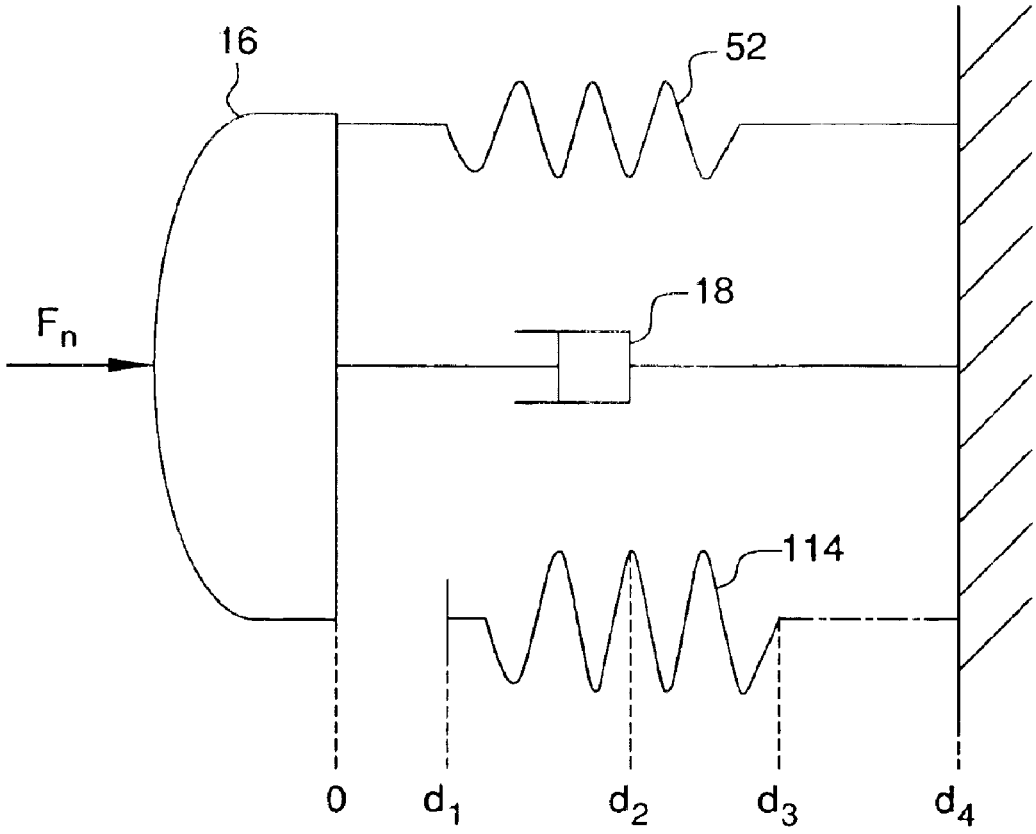
FIG. 9 is a schematic illustration of the force and travel distance characteristics of the switch assembly of the present invention.

The actuation force applied to the pushbutton 16 is identified in FIG. 6 as $F_n$ to indicate that the actuation force will not be constant during the travel of the pushbutton 16 between the fully-released position shown in FIG. 5 and the fully-engaged position shown in FIG. 6. Referring to the graphical illustration of FIG. 8 and the schematic illustration of FIG. 9, the relationship between applied actuator force, Fn, and pushbutton travel is shown. The graphical illustration of FIG. 8 is meant to show relative relationships between the various parameters and should not be considered as presenting force and distance values to scale.

As shown, the pushbutton travel between the fully-released and fully-engaged positions includes four segments. In each of the four travel segments, the force that must be applied to the actuator pushbutton varies in response to changes in the resistance generated by the actuator assembly 24 and the switch mechanism 26. In the first travel segment, the actuation force will increase as the pushbutton return spring 52 is compressed and when the pin 68 contacts the pivot member 78. As shown in the input force profile of FIG. 8, the actuator force will increase in a substantially linear fashion throughout a majority of the first segment. This relationship is identified as slope, $s_1$. The first travel segment ends at distance, $d_1$, which corresponds to the point at which resistance generated by the actuator assembly 24 will be supplemented by resistance generated by the switch assembly 26.

In the second travel segment, the required actuator force will increase faster than it did in the first travel segment because of the combined resistance by the actuator assembly 24 and switch mechanism 26. Throughout much of the second segment, the relationship between the actuator force and travel distance will vary in a substantially linear manner. This relationship is shown and identified in FIG. 8 as second slope, $s_2$. As shown, the second slope, $s_2$, is greater than the first slope, $s_1$, because of the combined nature of the resistance in the second travel segment. The second travel segment ends at distance $d_2$, corresponding to an actuator force, $F_2$, sufficient to overcome the contact force for switching movement of the switch plate 88.

In the third travel segment, the actuation force reduces from $F_2$ to $F_3$, which corresponds to the resisting force generated by the actuator assembly 24 alone. The pushbutton travel distance at this point is identified as $d_3$. In the fourth travel segment, the actuator force again increases in response to further compression of the pushbutton return spring 52. The fourth travel segment ends at distance d4 at the fully-engaged, hard stop, position for the pushbutton 16 shown in FIG. 6.

As described above, factors such as ringing noises associated with a switch assembly affect a user's perception of quality. The amount of force required to actuate the switch mechanism may also affect a user's perception. It was found that the particular relationship between the varying actuator force and the pushbutton travel in the above-described profile travel segments also has a large effect on perceived quality for a given switch assembly.

The relationship between the first and second slopes $s_1$ and $s_2$, associated with the first and second travel segments for example, can have a dramatic effect on perceived quality. Two switch assemblies having the same actuation force and distance values, $F_2$ and $d_2$, may nevertheless be perceived as varying in quality of construction depending on the relationship between the slopes $s_1$ and $s_2$. If $s_1$ is too large, the tactile perception of transition between the first and second travel segments may become masked. This provides a switch that may feel "mushy" to a user. Conversely, a pushbutton switch having an excessively small value for $s_1$ will present a sudden transition to a user in the nature of impact with an obstacle.

The above-described construction of the switch assembly 10 provides for the desirable force/travel relationship shown in FIG. 8. The relationship between the slopes $s_1$ and $s_2$ is preferably as follows:

$$0.30\ (\text{approx.}) \leqq s_1/s_2 \leqq 0.60\ (\text{approx.})$$

It is also desirable, irrespective of the particular relationship between the slopes s1 and $s_2$, that the travel distance, $d_2$, required to achieve switching actuation not be excessively large. In the above-described 15 Amp, 120–277V switch assembly adapted for use in a standard toggle-type faceplate, the actuator force, $F_2$, was approximately 0.8 pounds. It is preferable that the associated travel distance, $d_2$, be approximately 0.120 inches or less.

Referring again to FIG. 8, perceived quality may also be affected by the relationship between the actuator force and pushbutton travel in the third and fourth travel segments. As shown, the preferred relationship in the third and fourth travel segments provides a substantially V-shaped portion of the input profile. The preferred V-shaped relationship may be defined in terms of the distances $d_2$, $d_3$, $d_4$ and the forces $F_2$ and $F_3$ in accordance with the following equations:

$$(d_3-d_2)/d_3 \leqq 0.15 \text{ (approx.)} \quad 1.$$

$$0.10 \text{ (approx.)} \leqq (d_4-d_3)/d_4 \leqq 0.30 \text{ (approx.)} \quad 2$$

$$0.10 \text{ (approx.)} \leqq (F_2-F_3)/F_2 \leqq 0.30 \text{ (approx.)} \quad 3$$

As described previously, noises such as ringing of the spring 114 may detrimentally affect perceptions regarding the quality of the switch assembly construction. A certain amount of audible feedback associated with the snapping movement of the switch plate 88 as it is moved between its alternate positions, however, is desirable. The audible feedback associated with the switch plate movement should occur shortly after the point shown at which $F_2$ of FIG. 8 is applied to the pushbutton 16. Preferably, the audible feedback associated with the snapping movement occurs within approximately 10 milliseconds after the $F_2$, $d_2$ point of FIG. 8 is reached. Preferably, the audible feedback associated with the snapping movement will have a sound level of approximately 40 dB at a distance of approximately 2 inches from the pushbutton 16 in an ambient of 22 dB.

Visual feedback may also affect perceptions of quality. It is desirable that visual indication of power supply to an electrical load, such as light from a lamp, occur shortly after the $F_2$ point of FIG. 8. Preferably the visual feedback occurs within approximately 50 milliseconds after the $F_2$ point of FIG. 8 is reached.

The present invention is not limited to the particular construction shown and may have application to switches having application to switches having pushbuttons of various dimensions and switches having varying switching capabilities.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A switch assembly for controlling an electrical load, the switch assembly comprising:

a switch mechanism including a pivot member supported for pivoting about an axis and a switch plate adapted for movement between first and second fixed positions through contact with the pivoting pivot member; and an actuator assembly including a slidably supported pushbutton, the actuator assembly adapted to engage the switch mechanism during inward translation of the pushbutton in response to force applied to the pushbutton for switching the switch mechanism between the first and second fixed positions, the actuator assembly adapted to outwardly bias the pushbutton for return translation of the pushbutton following removal of the force from the pushbutton, the force applied to the pushbutton varying during input traveling of the pushbutton between a fully-released pushbutton position and a fully-engaged pushbutton position, the relationship between actuator force and pushbutton travel distance defining a multiple segment input profile, a first segment of the input profile including the fully-released position, the applied force varying in the first segment from resistance generated by the actuator assembly to provide for the outward return of the pushbutton, the applied force in at least a substantial portion of the first segment varying in substantially linear fashion along a first slope, $S_1$, the applied force varying in the second segment from a combination of the pushbutton return resistance and resistance generated by the switch mechanism against movement between the first and second fixed positions, the applied force in at least a substantial portion of the second segment varying in substantially linear fashion along a second slope, $S_2$, the relationship between the first and second slopes, $s_1$ and $s_2$, being defined by the following equation:

$$0.30 \text{ (approx.)} \leqq s1/s2 \leqq 0.60 \text{ (approx.)}.$$

2. The switch assembly according to claim 1, wherein the actuator assembly includes a return spring operably contacting the pushbutton for providing the outward return of the pushbutton following release of the applied force.

3. The switch assembly according to claim 1, wherein the switch mechanism includes a switch plate supported for movement between first and second positions associated with the first and second fixed positions of the switch mechanism.

4. The switch assembly according to claim 3, wherein the switch mechanism includes a spring located between the pivot member and the switch plate for maintaining the switch plate in either one of the first and second positions of the switch plate.

5. A switch assembly for controlling an electrical load, the switch assembly comprising:

a switch mechanism including a pivot member supported for pivoting about an axis and a switch plate adapted for movement between first and second fixed positions through contact with the pivoting pivot member; and an actuator assembly including a slidably supported pushbutton, the actuator assembly adapted to engage the switch mechanism during inward translation of the pushbutton in response to force applied to the pushbutton for switching the switch mechanism between the first and second fixed positions, the actuator assembly adapted to outwardly bias the pushbutton for return translation of the pushbutton following removal of the force from the pushbutton, the force applied to the pushbutton varying during input traveling of the pushbutton between a fully-released pushbutton position and a fully-engaged pushbutton position from resistance respectively generated by the actuator assembly for outward return of the pushbutton and by the switch mechanism against switching movement, the relationship between actuator force and pushbutton travel distance defining a multiple segment input profile, the applied force having a value $F_s$ at a pushbutton travel distance of $d_s$ when sufficient force has been applied to the pushbutton for switching actuation of the switch mechanism to occur, the applied force reducing from $F_s$ at travel distance $d_s$ to $F_r$ at a pushbutton travel distance as the resistance against switching actuation is removed, the travel distance at the fully-engaged position having a value $d_e$, the input profile values of $F_s$, $F_r$, $d_s$, $d_r$ and $d_e$ defining a substantially V-shaped portion of the profile according to the following equations:

$$(dr-ds)/dr \leqq 0.15 \text{ (approx.)} \quad \text{A.}$$

$$0.10 \text{ (approx.)} \leqq (de-dr)/de \leqq 0.30 \text{ (approx.)} \quad \text{B.}$$

$$0.10 \text{ (approx.)} \leqq (Fs-F_r)/Fs \leqq 0.30 \text{ (approx.)}. \quad \text{C.}$$

6. The switch assembly according to claim 5, wherein the actuator assembly includes a return spring operably contacting the pushbutton for providing the outward return of the pushbutton following release of the applied force.

7. The switch assembly according to claim 5, wherein the switch mechanism includes a switch plate supported for movement between first and second positions associated with the first and second fixed positions of the switch mechanism.

8. The switch assembly according to claim 7, wherein the switch mechanism includes a spring located between the pivot member and the switch plate for maintaining the switch plate in either one of the first and second positions of the switch plate.

9. The switch assembly according to claim 5, wherein the applied force of the input profile reaches a value of $F_e$ at $d_e$, and wherein $F_e$ is less than $F_s$.

10. A switch assembly for controlling an electrical load, the switch assembly including an actuator assembly and a switch mechanism, the actuator assembly releasably engageable with the switch mechanism to switch the mechanism between first and second fixed electrical states, the actuator assembly comprising:

a pushbutton received by a pushbutton guide for inward translation of the pushbutton with respect to the switch assembly;

a return member for outwardly biasing the pushbutton with respect to the switch assembly;

a retainer located between the pushbutton and the switch mechanism, the retainer providing a reaction surface engaged by the return member for outwardly biasing the pushbutton; and an elongated actuator member having switch-engaging and pushbutton-engaging portions at opposite ends of an intermediate portion, the pushbutton-engaging portion of the actuator located between the retainer and the pushbutton, the intermediate portion of the actuator dimensioned for translatable receipt through an opening in the retainer, the elongated actuator member operably driven by the pushbutton during inward translation of the pushbutton for releasable engagement between the switch-engaging portion of the actuator member and the switch mechanism, the opening in the retainer being elongated to provide for lateral pivoting of the actuator member with respect to the retainer during switching of the switch mechanisms wherein the return member is a spring having coils and wherein the actuator member is a pin including an elongated shaft portion and a head portion, the shaft portion receivable within the coils of the return spring through a first end of the return spring, the head portion defining a shoulder dimensioned for contact with the first end of the return spring.

11. The switch assembly according to claim 10, wherein the pushbutton includes a cap defining an interior and a carrier, the carrier including a stand portion and a pedestal portion, the stand portion of the carrier adapted for receipt within the interior defined by the cap.

12. The switch assembly according to claim 11, wherein the pushbutton guide includes opposite end walls and wherein the pedestal portion of the pushbutton carrier is dimensioned for sliding translation between the end walls of the pushbutton guide.

13. The switch assembly according to claim 11, wherein the pushbutton carrier includes tab projections adapted for engagement with openings in the pushbutton cap for releasably securing the pushbutton cap to the pushbutton carrier.

14. The switch assembly according to claim 10, wherein the return spring is conical in shape to provide for the lateral pivoting of the pin and wherein the actuator assembly further comprises a receptacle connected to the pushbutton, the receptacle defining a bell-shaped interior dimensioned for receipt of the conical return spring.

15. The switch assembly according to claim 10, wherein the pushbutton guide includes opposite end walls and wherein the actuator assembly includes tab projections connected to the end wails of the pushbutton guides, the tab projections adapted for receipt within openings in the retainer for releasably securing the retainer to the pushbutton guide.

16. The switch assembly according to claim 10, wherein the switch assembly further includes a base housing in which the switch assembly is mounted and wherein the pushbutton guide is connected to an actuator mount adapted for receipt by the base housing.

17. The switch assembly according to claim 16, wherein the actuator mount includes at least one projecting portion dimensioned for receipt within a recess formed in an upstanding sidewall of the base housing.

18. The switch assembly according to claim 10, wherein the switch mechanism includes a pivot member supported for pivoting about an axis and a switch plate supported for switching movement between first and second positions associated with the first and second fixed electrical states.

19. The switch assembly according to claim 18, wherein the pivot member is adapted for contact with the switch plate during pivoting of the pivot member.

20. The switch assembly according to claim 10, wherein the switch mechanism includes a pivot member supported for pivoting about an axis, the pivot member including a body defining a cross section having a substantially V-shaped middle portion and opposite end portions defining ledge extensions, the pin shall laterally pivoting upon contact with the V-shaped middle portion of the pivot member body and translating along the body middle portion for contact with one of the opposite ledge extensions.

21. A switch assembly for controlling an electrical load, the switch assembly including a switch mechanism and an actuator assembly having a slidably supported pushbutton, the actuator assembly adapted to engage the switch mechanism during inward translation of the pushbutton, the switch mechanism comprising:

a switch plate having opposite upper and lower edges, the switch plate including at least one recess along the lower edge to define supports at opposite ends of the switch plate having contact surfaces for supporting the switch plate on a support surface;

a pivot member supported for pivoting about an axis, the pivot member adapted for contact with the switch plate adjacent the upper edge of the switch plate such that pivoting of the pivot member causes switching movement of the switch plate;

first and second contact elements secured to opposite sides of the switch plate, the contact elements respectively contacting first and second fixed contact surfaces of the switch assembly when the switch mechanism is switched between alternating first and second closed contact positions; and a spring located between the pivot member and the switch plate to apply a contact force between the contact elements and the fixed contact surfaces to maintain the switch mechanism in one of the alternate closed contact positions, the switch plate including at least one recess along the upper edge for receiving one end of the spring, the at least one recess in the upper edge extending to a terminal end located to provide for substantial alignment between the end of the spring and a center of each of the contact elements.

22. The switch assembly according to claim 21, wherein the switch mechanism further comprises a switch plate holder, the switch plate holder including a portion defining a well in which the switch plate is received for support of the switch plate by contact between the switch plate supports and a surface of the switch plate holder well.

23. The switch assembly according to claim 22, wherein the switch plate holder further includes an arm extension connected to the well portion, and wherein the arm extension defines a first one of the fixed contact surfaces.

24. The switch assembly according to claim 23 wherein the switch mechanism further includes a contact element support prong and a contact element secured to the contact element support prong, and wherein the contact element secured to the contact element defines the second one of the fixed contact surfaces support prong defines the second one of the fixed contact surfaces.

25. The switch assembly according to claim 24, wherein the switch assembly includes a base housing in which the switch mechanism is mounted, and wherein the contact element support prong is connected to a traveler terminal received by the base housing.

26. The switch assembly according to claim 21, wherein the spring located between the pivot member and the switch plate includes coils and wherein the switch mechanism further comprises a damper received within the coils of the spring, the damper dimensioned for contact with the coils to limit resonating vibration of the coils following a change in relative angular orientation of the pivot member and the switch plate from actuation of the switch mechanism.

27. The switch assembly according to claim 21, wherein the pivot member includes a body defining a cross section that includes a substantially V-shaped middle portion and opposite end portions defining ledge extensions, and wherein the actuator assembly includes an actuator member adapted for contact with the body middle portion and translation therealong for contact with one of the body ledge extensions.

28. The switch assembly according to claim 27, wherein the actuator member of the actuator assembly is an elongated pin including a shaft portion having a tapered end for contact with the pivot member of the switch mechanism.

29. The switch assembly according to claim 28, wherein the actuator assembly further includes a retainer located between the switch mechanism and the pushbutton, and wherein the shaft portion of the pin is dimensioned for receipt through an opening in the retainer, the opening being elongated to provide for lateral pivoting of the pin with respect to the retainer during contact between the pin and the pivot member.

30. The switch assembly according to claim 29, wherein the actuator assembly further includes a return spring for outward return of the pushbutton. following actuation of the switch mechanism, the return spring including coils, and wherein the pin is received within the coils of the return spring, the pin including a head portion dimensioned for contact with an end of the return spring to provide for outward return of the pin with the pushbutton following actuation of the switch assembly.

31. A switch assembly for controlling an electrical load, the switch assembly including a switch mechanism and an actuator assembly adapted to engage the switch mechanism, the switch assembly comprising:

a pivot member supported for pivoting about an axis;

a spring having coils and located between the pivot member and an adjacently located member of the switch assembly; and a spring damper received within the coils of the spring and contacting the coils to limit resonating vibrations of the coils following a change in relative angular orientation between the pivot member and the adjacently located member.

32. The switch assembly according to claim 31, wherein the spring damper is cylindrical.

33. The switch assembly according to claim 31, wherein the spring damper is made from a resilient material.

34. The switch assembly according to claim 31, wherein the spring damper is made from a foam material.

35. The switch assembly according to claim 31, wherein the spring has an axial stiffness, and wherein the spring damper has a stiffness that is less than the spring stiffness to limit interference by the spring damper with axial compression of the spring.

36. A light switch assembly providing aural and visual feedback to a user, the light switch assembly comprising:

a switch mechanism including a pivot member supported for pivoting about an axis and a switch plate adapted for movement between first and second fixed positions through contact with the pivoting pivot member; and an actuator assembly including a slidably supported pushbutton, the actuator assembly adapted to engage the switch mechanism during inward translation of the pushbutton in response to force applied to the pushbutton for switching the switch mechanism between the first and second fixed positions, the actuator assembly adapted to outwardly bias the pushbutton for return translation of the pushbutton following removal of the force from the pushbutton, the force applied to the pushbutton varying during input traveling of the pushbutton between a fully-released pushbutton position and a fully-engaged pushbutton position from resistance respectively generated by the actuator assembly for outward return of the pushbutton and by the switch mechanism against switching movement, the relationship between actuator force and pushbutton travel distance defining a multiple segment input profile, the applied force having a value $F_s$ at a pushbutton travel distance of $d_s$ when sufficient force has been applied to the pushbutton for switching actuation of the switch mechanism to occur, the applied force reducing from $F_s$ at travel distance $d_s$ to $F_r$ at a pushbutton travel distance $d_r$ as the resistance against switching actuation is removed, the travel distance at the fully-engaged position having a value $d_e$, the input profile values of $F_s$, $F_r$, $d_s$, $d_r$ and $d_e$ defining a substantially V-shaped portion of the profile, the actuation of the switch mechanism creating an aural feedback within less than approximately 10 milliseconds of the application of force $F_s$ to the pushbutton and visual feedback provided by illumination of a lighting load controlled by the switch within less than approximately 50 milliseconds of the application of force $F_s$ to the pushbutton.

37. A light switch assembly that provides aural and visual feedback to a user, the light switch assembly comprising:

a switch mechanism including a pivot member supported for pivoting about an axis and a switch plate adapted for movement between first and second fixed positions through contact with the pivoting pivot member; and an actuator assembly including a slidably supported pushbutton, the actuator assembly adapted to engage the switch mechanism during inward translation of the pushbutton in response to force applied to the pushbutton for switching the switch mechanism between the first and second fixed positions, the actuator assembly adapted to outwardly bias the pushbutton for return translation of the pushbutton following removal of the force from the pushbutton, the force applied to the pushbutton varying during input traveling of the pushbutton between a fully-released pushbutton position and a fully-engaged pushbutton position from resistance respectively generated by the actuator assembly for outward return of the pushbutton and by the switch mechanism against switching movement, the relationship between actuator force and pushbutton travel distance defining a multiple segment input profile, the applied force having a value of Fc at a pushbutton travel distance of dc when contact between the actuator assembly and the switch mechanism creates resistance that is added to the resistance provided by the actuator assembly for return of the pushbutton, the applied force having a value $F_s$ at a pushbutton travel distance of $d_s$ when sufficient force has been applied to the pushbutton for switching actuation of the switch mechanism to occur, the applied force reducing from $F_s$ at travel distance $d_s$ to $F_r$ at a pushbutton travel distance $d_r$, as the resistance against switching actuation is removed, the travel distance at the fully-engaged position having a value $d_e$, the input profile including four segments respectively defined between the fully released position, distance $d_e$, distance $d_s$, distance dr and the $d_e$, the first and second segments being substantially linear and respectively defining first and second slopes $s_1$ and $s_2$, the value of $s_1$ being between approximately 30 percent and 60 percent of the value of $s_2$, the input profile values of $F_s$, $F_r$, $d_s$, $d_r$ and $d_e$ defining a substantially V-shaped portion of the profile, the switching of the switch mechanism creating an audible feedback, the light switch assembly providing for aural feedback by the switch mechanism and visual feedback by illumination of a lighting load controlled by the light switch assembly within a limited time period following application of force $F_s$ to the pushbutton.

38. The switch assembly according to claim 37, wherein the audible feedback occurs within less than approximately 10 milliseconds of the application of force $F_s$ to the pushbutton.

39. The switch assembly according to claim 38, wherein the visual feedback occurs within less than approximately 50 milliseconds of the application of force $F_s$ to the pushbutton.

40. A switch assembly for controlling an electrical load, the switch assembly comprising:

an actuator assembly including a pushbutton, a pushbutton guide, a pushbutton return spring, an actuator pin and a retainer, the pushbutton slidably received by the pushbutton guide, the retainer connected to the pushbutton guide, the pushbutton return spring located between the pushbutton and the retainer to outwardly bias the pushbutton, the actuator pin including a shaft portion received through an opening in the retainer, the retainer opening being elongated to allow for lateral pivoting of the pin shaft portion with respect to the retainer; and a switch mechanism including a pivot member, a switch plate and a contact spring, the pivot member supported for pivoting about a first axis, the switch plate supported along an edge of the switch plate for pivoting movement about a second axis between first and second switch plate positions, the contact spring located between the pivot member and the switch plate, the contact spring reacting against the pivot member to apply a force to the switch plate tending to maintain the switch plate in one of the switch plate positions.

* * * * *